US008899821B2

(12) United States Patent
Herz et al.

(10) Patent No.: US 8,899,821 B2
(45) Date of Patent: Dec. 2, 2014

(54) DEVICE HAVING A DETACHABLE CONNECTION BETWEEN A SAMPLE HOLDER AND A SHAKING APPARATUS FOR MIXING A LIQUID SAMPLE

(75) Inventors: Achim Herz, Gross-Gerau (DE); Thorsten Michels, Gross-Gerau (DE); Holger Pufahl, Liederbach (DE); Joerg Schmiedeskamp, Wiesbaden (DE); Alexander Wiedekind-Klein, Steinbach (DE)

(73) Assignee: Siemens Healthcare Diagnostics Products GmbH, Marburg (DE)

( * ) Notice: Subject to any disclaimer, the term of this patent is extended or adjusted under 35 U.S.C. 154(b) by 1103 days.

(21) Appl. No.: 12/876,459

(22) Filed: Sep. 7, 2010

(65) Prior Publication Data

US 2011/0086432 A1 Apr. 14, 2011

(30) Foreign Application Priority Data

Oct. 10, 2009 (DE) ..... 10 2009 048 918

(51) Int. Cl.
*B01F 11/00* (2006.01)
*B01F 15/00* (2006.01)

(52) U.S. Cl.
CPC ..... *B01F 11/0022* (2013.01); *B01F 15/00253* (2013.01); *B01F 11/0008* (2013.01); *B01F 11/0014* (2013.01)
USPC ..... 366/110; 366/209

(58) Field of Classification Search
CPC ..... B01F 11/0008; B01F 11/0014; B01F 11/0031; B01F 11/0037
USPC ..... 366/108–128, 208–219
See application file for complete search history.

(56) References Cited

U.S. PATENT DOCUMENTS

| | | | | |
|---|---|---|---|---|
| 3,061,280 | A * | 10/1962 | Kraft et al. | 366/110 |
| 3,159,384 | A * | 12/1964 | Davis | 366/110 |
| 3,346,241 | A | 10/1967 | Schubert | 366/209 |
| 5,195,825 | A * | 3/1993 | Ringrose | 366/213 |
| 5,558,839 | A * | 9/1996 | Matte et al. | |
| 5,642,938 | A * | 7/1997 | Nakagawa et al. | 366/110 |
| 5,947,594 | A * | 9/1999 | Dolatli et al. | 366/110 |
| 6,506,344 | B1 | 1/2003 | Fickenscher et al. | |
| 8,215,826 | B2 | 7/2012 | Zuppiger et al. | 366/208 |
| 8,696,990 | B2 * | 4/2014 | Meller et al. | |
| 2007/0211566 | A1 * | 9/2007 | Ebers et al. | 366/208 |
| 2008/0056059 | A1 | 3/2008 | Manera et al. | |

(Continued)

FOREIGN PATENT DOCUMENTS

| | | |
|---|---|---|
| DE | 517202 | 1/1931 |
| DE | 816915 C | 7/1949 |

(Continued)

OTHER PUBLICATIONS

Japanese Office Action, Application No. 2010227444, 7 pages.

*Primary Examiner* — Charles Cooley
(74) *Attorney, Agent, or Firm* — King & Spalding L.L.P.

(57) ABSTRACT

A device and a process for mixing a liquid sample in an automated analysis instrument comprises a support arm, a holder for a liquid container, a flexible intermediate element, arranged between the support arm and the holder for the liquid container, a shaking apparatus, and a coupling apparatus arranged on the holder for the liquid container, wherein the coupling apparatus can establish a detachable connection between the shaking apparatus and the holder for the liquid container.

17 Claims, 2 Drawing Sheets

(56) References Cited

U.S. PATENT DOCUMENTS

| | | | | |
|---|---|---|---|---|
| 2009/0097948 | A1 | 4/2009 | Zuppiger et al. | |
| 2011/0019497 | A1 | 1/2011 | Kotera et al. | 366/116 |
| 2011/0086432 | A1 * | 4/2011 | Herz et al. | 436/174 |

FOREIGN PATENT DOCUMENTS

| | | | | |
|---|---|---|---|---|
| DE | 1701288 | U | 6/1955 | |
| DE | 2255707 | A1 | 5/1974 | |
| DE | 2941421 | A1 | 4/1981 | B01F 11/00 |
| DE | 19715566 | A1 | 10/1998 | B01F 11/00 |
| EP | 0 742 435 | A1 | 11/1996 | |
| EP | 1 008 844 | A1 | 6/2000 | |
| JP | 6144223 | U | 3/1986 | B01F 11/00 |
| JP | 01141467 | U | 9/1989 | B01F 11/00 |
| JP | 06201705 | A | 7/1994 | G01N 33/02 |
| JP | 08299775 | A | 11/1996 | B01F 11/00 |
| JP | 2008540071 | A | 11/2008 | B01F 11/00 |
| WO | 2006/116892 | A1 | 11/2006 | B01F 11/00 |
| WO | 2009/119918 | A2 | 10/2009 | B01F 11/00 |

* cited by examiner

DEVICE HAVING A DETACHABLE CONNECTION BETWEEN A SAMPLE HOLDER AND A SHAKING APPARATUS FOR MIXING A LIQUID SAMPLE

CROSS-REFERENCE TO RELATED APPLICATIONS

This application claims priority to German Patent Application No. 10 2009 048 918.5 filed Oct. 10, 2009, the contents of which is incorporated herein by reference in its entirety.

TECHNICAL FIELD

The present invention relates to a device and a process for mixing and for possibly transporting a liquid sample for use in automated analysis instruments for microbiology, analysis, forensics or clinical diagnostics.

BACKGROUND

Automated analysis instruments, as are currently used routinely in microbiology, analysis, forensics and clinical diagnostics, generally carry out a sequence of continuously repeating work steps. In many of these work steps, different materials have to be mixed together as homogeneously as possible in order to supply precise examination results. The necessity for uniform mixing particularly relates to liquid samples, such as blood, serum or plasma samples. By way of example, these have to be mixed homogeneously with analysis reagents before they are supplied to an analysis unit.

By way of example, for this purpose, there are devices in the prior art that use a magnetic stirrer for mixing. However, these devices harbor the risk of contaminating the container contents by particles that can adhere to the magnetic stirrer and reach the sample with the latter.

A further known approach is offered by the cuvette rotors of the coagulation analyzers BCS® and BCS® XP from Siemens Healthcare Diagnostics. In these instruments, liquids are pipetted into different, mutually separate chambers in a cuvette rotor. Fast rotation of the rotor and the centrifugal forces occurring thereby hurl the liquids into an outer chamber, where they mix. However, this arrangement requires a plurality of chambers and a relatively complex design. By way of example, such cuvette rotors are described in EP 1008844 A1.

Additionally, EP 742435 A1 has disclosed a gripper consisting of two gripper arms that are pulled together by a spring. This gripper is attached to a holding element coupled to a transfer arm. The combination of transfer arm and holding element can be e.g. part of a robotic station for treating, manipulating and analyzing chemical, clinical and/or biological samples. Here, a connection element is used to connect the holding element to a motor, which acts as a shaking apparatus by means of an eccentric. When this motor rotates, the gripper is made to oscillate. If the gripper has gripped a sample vessel with liquid contents, there is mixing of the liquid in the sample container as a result of the transmission of the oscillation from the motor to the gripper.

However, this device does not ensure that the oscillation caused by the motor also arrives at the cuvette in all cases. The inventors have observed that in certain cases the oscillations are at least partly transmitted to the transfer arm and thus oscillate e.g. the robotic station, which impairs the mixing result and can possibly even put the robotic station at risk.

Additionally, the transmission of the oscillation onto the cuvette can be impaired as soon as parts of the device get caught or jammed. Furthermore, the developing oscillation of the cuvette can have varying effects as a result of variations in or faults of involved components. This is undesirable since all cuvettes should mix as identically as possible, even over different instruments.

Additionally, the motor is also moved every time the transfer arm is moved, which can impair the functionality of the device.

SUMMARY

According to various embodiments, a device for mixing a liquid sample can be provided, which device avoids the aforementioned disadvantages.

More particularly, according to various embodiments, a device for mixing a liquid sample can be provided which ensures that the movement generated by a shaking apparatus, more particularly a rotational movement generated by a shaking apparatus, are transmitted, to the greatest possible extent and in a reproducible fashion, to a container with contents to be mixed, e.g. a cuvette.

Furthermore, it should preferably also be possible to monitor this movement.

According to an embodiment, a device for mixing a liquid sample, may have a support arm, a holder for a liquid container, at least one flexible intermediate element, arranged between the support arm and the holder for the liquid container, a shaking apparatus, and a coupling apparatus arranged on the holder for the liquid container, wherein the coupling apparatus can establish a detachable connection between the shaking apparatus and the holder for the liquid container.

According to a further embodiment, the flexible intermediate element may consist of an elastic and/or damping material. According to a further embodiment, the flexible intermediate element may consist of a rubber disk. According to a further embodiment, the support arm may be a transfer arm, with the aid of which the holder for the liquid container can be moved. According to a further embodiment, the liquid container can be at least one container selected from the group containing a microreaction vessel, a photometer cuvette and a centrifuge vessel. According to a further embodiment, the device furthermore may have a sensor that can be used to monitor the mixing procedure in the liquid container. According to a further embodiment, the shaking apparatus and the holder may be only interconnected during the mixing procedure. According to a further embodiment, the holder for the liquid container may have an integrally formed gripper for the liquid container. According to a further embodiment, the shaking apparatus can be designed such that it can move. According to a further embodiment, the coupling apparatus may have a coupling hole or a coupling pin, which is designed such that it can mesh with a complementary arrangement on the shaking apparatus. According to a further embodiment, the shaking apparatus may have a motor-driven eccentric. According to a further embodiment, the shaking apparatus may have a loudspeaker.

According to another embodiment, an automated analysis instrument for treating, manipulating and analyzing chemical and/or biological samples, may have a device as described above.

According to yet another embodiment, a process for mixing a liquid sample, may comprise the following steps: a) holding a liquid container containing the liquid sample by means of a holder, b) coupling the holder to a shaking apparatus by means of a coupling apparatus, c) mixing the liquid sample, d) decoupling the holder from the shaking apparatus.

According to a further embodiment of the above process, the process may furthermore comprise at least one of the following steps: e) gripping the liquid container before the mixing commences, f) transporting the liquid container on after decoupling, and/or g) releasing the container. According to a further embodiment of the above process, the shaking apparatus and the holder may be only interconnected during the mixing. According to a further embodiment of the above process, the process may be performed by a device as described above.

BRIEF DESCRIPTION OF THE DRAWINGS

The various embodiments are explained in more detail by the figures shown and discussed below. In doing so, it should be noted that the figures are only descriptive and are not intended to restrict the invention in any way.

DETAILED DESCRIPTION

Figure 1:
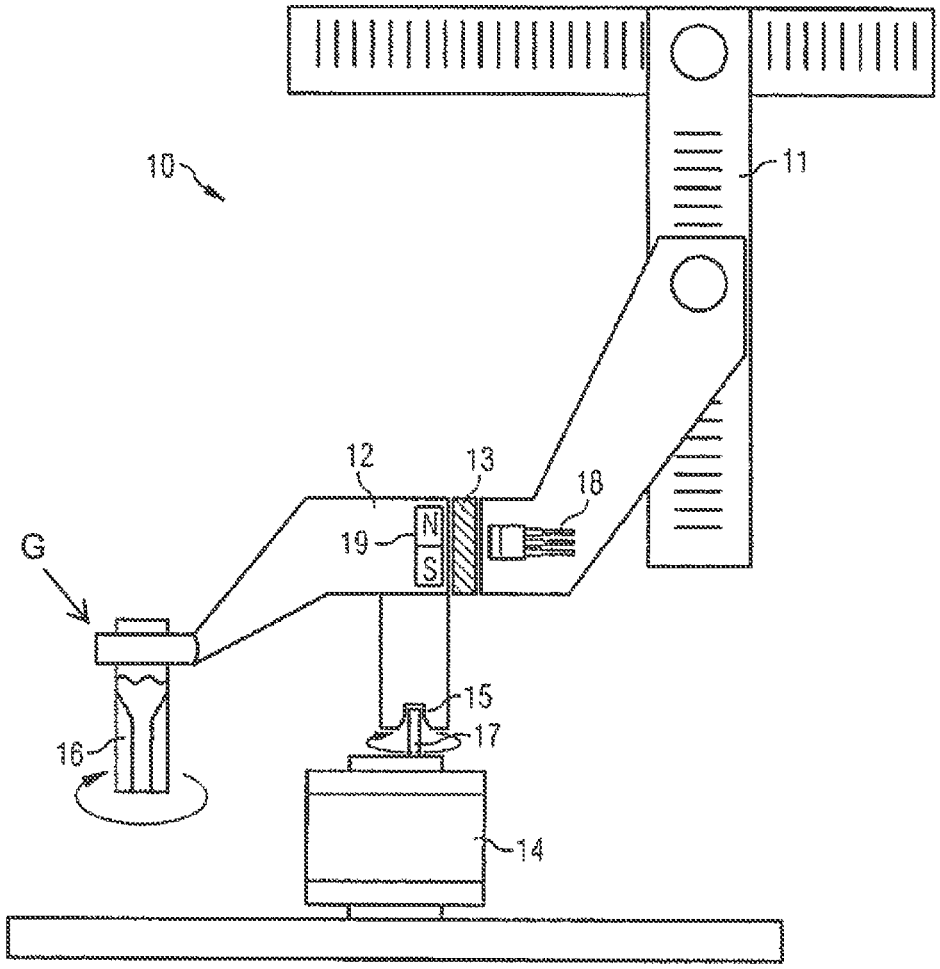
FIG. 1 shows an embodiment of the device 10, in which the shaking apparatus 14 has a motor and the coupling apparatus 15 has a coupling hole that complements an eccentric pin 17.

According to various embodiments, provision is made for a device for mixing a liquid sample, having a) a support arm,
b) a holder for a liquid container,
c) at least one flexible intermediate element, arranged between the support arm and the holder for the liquid container,
d) a shaking apparatus, and
e) a coupling apparatus arranged on the holder for the liquid container, wherein
f) the coupling apparatus can establish a detachable connection between the shaking apparatus and the holder for the liquid container.

The device according to various embodiments can be integrated in e.g. a laboratory robot and, due to the provided flexible intermediate element, can be advantageous in that the vast majority of possible movements of the shaking apparatus can be ensured to be transmitted to the liquid container without the mobility of the holder for the liquid container being reduced to an up and down motion. The flexible intermediate element ensures that a planar circular motion generated by a shaking apparatus and transmitted to the holder for the liquid container is not transmitted to the support arm via a coupling apparatus. If the planar circular motion transferred to the holder for the liquid container by means of the shaking apparatus would also be transmitted to the support arm, this would result in cycle errors in the actuation of the support arm.

Since the shaking apparatus is detachably connected to the support arm in various embodiments, it need not also be moved during every movement of the support arm, as is the case in the device as per EP 0742435 A1.

Additionally, an advantage of the device according to various embodiments can be that there is no need to touch the contents of a liquid container with other auxiliary means when mixing the contents to be mixed of said liquid container, because neither magnetic particles nor magnetic pins have to be put into the liquid container for mixing, as is the case in magnetic mixing arrangements.

In the following text, the term "flexible intermediate element" should denote an apparatus that is attached between the holder and the support arm, damps the movement of the shaking apparatus, prevents movement from being transmitted to the support arm and allows the holder enough mobility during the shaking procedure in order to ensure optimum and efficient mixing of the liquid in the liquid container but at the same time is rigid enough to allow a support arm and holder to pick up, transport and put down cuvettes.

Provision can preferably be made in the device according to various embodiments for the flexible intermediate element to consist of an elastic and/or damping material such as—but not limited to—elastomers, urethane rubber, caoutchouc, rubber, foam or spring steel. Additionally, a plurality of separate intermediate elements can be used next to or above one another in order to ensure security against twisting.

The flexible intermediate element ensures that it is the liquid container and not the support arm with possibly further system components arranged thereon that is shaken, and that the holder for the liquid container is sufficiently mobile (i.e. shakable) in order to obtain optimum mixing of the liquid sample in the liquid container. However, at the same time, the thickness thereof also delimits the deflection of the gripper when transporting the vessel.

In the following text, the term "support arm" should denote an apparatus on which the holder for the liquid container is arranged via the flexible intermediate piece.

The support arm may preferably be a transfer arm, with the aid of which the holder for the liquid container can be moved.

The latter is particularly sensible if the transfer arm is part of a robotic station for treating, manipulating and analyzing chemical, clinical and/or biological samples. In the process, the transfer arm serves, for example, to transport liquid containers such as cuvettes from a pipetting station to a photometer or a PCR cycler.

Here, the transfer arm may preferably be displaced by robotic means. It may furthermore preferably be part of a laboratory machine or laboratory system, for example for microbiology, analytics, forensics or clinical diagnostics.

The term "shaking apparatus" should in general describe an apparatus that sets liquid in the liquid container in motion in order to obtain mixing.

In an embodiment, the shaking apparatus has a motor-driven eccentric.

In mechanics and engineering, an eccentric is understood to be a control disk attached to a shaft, the center of which disk lies off the shaft axis. An eccentric can be used e.g. to convert rotary movements into translational movements and vice versa.

By way of example, the motor can be an electric motor, an actuator or a stepper motor. Here, the eccentric can be driven coaxially, but likewise via a belt drive or a pinion drive as well.

However, the shaking apparatus can likewise be an ultrasound shaking apparatus or a loudspeaker, with the aid of which oscillations can be transmitted onto the liquid container.

In the following text, the term "liquid container" should denote an apparatus that contains the liquid to be mixed and to be transported.

Furthermore, the liquid container may preferably be at least one container selected from the group containing microreaction vessels (e.g. a so-called "Eppendorf tube")
photometer cuvettes and/or
centrifuge vessels.

In the following text, the term "liquid sample" or "sample" should denote an amount of liquid as is usually used in microbiology, analytics, forensics or clinical diagnostics. The sample usually constitutes part of the liquid to be analyzed, e.g. in the case of a blood, plasma or serum sample. However, the sample can also constitute all the available liquid in exceptional circumstances.

Furthermore, in an embodiment, the device has a sensor that can be used to monitor the duration, the frequency and, qualitatively, the amplitude of the gripper movement and hence the mixing procedure in the liquid container. Said sensor can be preferably a Hall sensor.

A Hall sensor (also referred to as a Hall probe or a Hall transducer, named after Edwin Hall) utilizes the Hall Effect for measuring magnetic fields and fluxes or for registering the position. In the case of the device according to various embodiments, a magnet has been embedded into the holder for the liquid container in an embodiment, the magnetic field of which magnet being measured by a stationary Hall sensor. Since the field of the magnet at the location of the Hall sensor decreases as the distance between the Hall sensor and the magnet increases, the value of the magnetic field at the location of the Hall sensor can be used to calculate the position of the magnet relative to the Hall sensor and hence the distance of the holder for the liquid container relative to the Hall sensor.

In an embodiment, the motor and the holder for the liquid container are only interconnected during the mixing procedure.

In the following text, the term "holder" should denote an apparatus that can hold the liquid container. The holder can preferably also grip, hold and rerelease the liquid container. Here, it can be advantageous for the holder to have an integrally formed gripper for the liquid container.

In principle, gripping is a basic movement for picking up and holding, and establishes the connection between robot or analysis instrument and workpiece, in this case a liquid container. Here, the type of synergy and the number of contact planes are decisive for a secure connection. The synergy can be obtained by forced, interlocking or adhesive pairings. When utilizing a forced pairing, the hold is generated by exercising pressure on the workpiece surface. In contrast to this, the hold is brought about in the interlocking pairing by enveloping the workpiece by an equal shape. Here, the transmitted clamping forces are very small during secure guiding. In the case of an adhesive pairing, the contact with the workpiece is brought about by utilizing adhesion.

Moreover, the gripper systems can be subdivided into mechanical, pneumatic, magnetic and adhesive systems according to their effect. These effects can also be utilized in combination in order to increase the flexibility of the gripper system.

Mechanical grippers may preferably be used within the scope of this invention, but magnetic grippers in particular can also be used. There are one finger, two finger or multi-finger grippers as mechanical grippers with a rigid, rigid-hinged or elastic design.

EP 742435 A1 has disclosed a gripper consisting of two tongs that are pulled together by a spring. The production of this gripper is connected with increased costs and complexity because the various parts have to be assembled.

In contrast thereto, the gripper preferred here may be produced from a single piece. This allows reproducible production of an increased number of units since no individual parts have to be assembled and the proper operation of the assembled gripper only has to be checked randomly, but not for each individual unit.

The integral gripper is designed such that it can be deformed elastically and it is in a tensioned state. If it is moved against an obstruction with sufficient force, this results in a snap-effect and the gripper opens. Further movement in the direction of the obstruction causes the gripper to envelop the obstruction and said gripper snaps shut again due to the tensioned state as soon as the obstruction has been completely enveloped. Furthermore, the gripper only releases the enveloped obstruction when a release force is overcome, which force is necessary to reopen the gripper.

Thus, during the operation of the device, the holder for example firstly moves in the direction of a liquid container as a result of sideways motion or to and fro motion of the transfer arm. This liquid container, which can be preferably a cuvette, for example stands in a stand. When it reaches the cuvette, the holder is pressed open by a cuvette flange and it envelops the cuvette in the case of further displacement due to the spring action of the plastic material or the tensioned state. After the cuvette has been surrounded, said cuvette can be lifted by means of an upward motion of the holder or the transfer arm. The cuvette is now being held and can be displaced by means of movement of the transfer arm.

In order to put down the cuvette in the holder, said cuvette is driven into a stand by movement of the transfer arm such that the cuvette remains in the stand if the holder is retracted, that is to say the holder is again pressed open, it releases the cuvette and it is then closed again in an elastic fashion.

In the following text, the term "coupling apparatus" should denote an apparatus by means of which the shaking apparatus can be detachably connected to the holder for the liquid container, for example by means of an eccentric pin and a coupling hole.

Moreover, there may be preference for a coupling apparatus that has a coupling hole or a coupling pin, which is designed such that it can mesh with a complementary arrangement on the shaking apparatus. As a result of a chamfer arranged at the opening of the coupling hole, said coupling hole can always be driven directly onto the coupling pin, without the latter having to be driven into a particular position in advance.

Here, provision can preferably be made for the shaking apparatus to have a coupling pin, preferably in the form of an eccentric pin, which can mesh into a complementary coupling hole in the coupling apparatus. Such a refinement is particularly suitable when the shaking apparatus is a motor with an eccentric.

In alternative embodiments of the device, the coupling apparatus is present in the form of e.g. a friction coupling, a magnetic coupling or a flange coupling. Such a refinement is particularly suitable when the shaking apparatus is an ultrasound apparatus or a loudspeaker.

Moreover, the shaking apparatus can preferably be designed such that it can move.

As a result of such an arrangement, the shaking apparatus can be brought into contact with the holder for the liquid container before the mixing procedure commences. This is particularly expedient when the support arm is not designed in the form of a moveable transfer arm, and thus has reduced mobility.

Furthermore, according to various embodiments, provision is made for a robotic station or an automated analysis instrument for treating, manipulating and analyzing chemical and/or biological samples, with a device as described above.

Moreover, provision is made for a process for mixing a liquid sample, comprising the following steps:

a) holding a liquid container containing the liquid sample by means of a holder,
b) coupling the holder to a shaking apparatus by means of a coupling apparatus,
c) mixing the liquid sample,
d) decoupling the holder from the shaking apparatus.

Provision can preferably be made simultaneously with step c) for the mixing procedure to be monitored, for example with the aid of a Hall sensor that registers the movements of a magnet in the holder for the liquid container.

The process preferably also may comprise one of the steps of e) gripping the liquid container before the mixing commences, f) transporting the liquid container on after decoupling, and/or g) releasing the container.

Here, provision can be made, for example, for the container to be gripped in a pipetting station in step e), after reaction or sample liquid was pipetted into the container.

In step f), provision can likewise be made for the container to be driven to another station in a robot/analysis instrument, e.g. to a photometer, a PCR cycler or the like, after the mixing has been completed.

By way of example, step g) can provide for the container to be put down in a photometer, a PCR cycler or the like.

Provision can preferably be made in said process for the shaking apparatus and the holder to be only interconnected during the mixing.

According to various embodiments, provision is furthermore made for a process as per the aforementioned description, which is performed by the device as described above.

Additionally, according to various embodiments, provision is made for the use of such a device for carrying out an aforementioned process.

FIG. 1 shows an embodiment of the device. In this example, the device 10, which is part of an analysis instrument, comprises a transfer arm 11, a holder 12 having an integral gripper G for gripping a cuvette, a flexible intermediate element (in this case a rubber disk) 13 arranged between the transfer arm 11 and the cuvette holder 12, a shaking apparatus in the form of a motor 14, a coupling apparatus (in this case a coupling hole) 15 arranged on the cuvette holder, which coupling apparatus complements an eccentric pin 17 arranged on the motor 14, and a cuvette 16.

In such a device, the cuvette holder 12, and hence the cuvette 16 as well, can thus be displaced within the analysis instrument by moving the transfer arm 11. In order to mix the sample in the cuvette, the coupling hole 15 is lowered onto the eccentric pin 17, and so a detachable connection is created therebetween. The movement of the motor 14 can then be transferred to the cuvette holder 12 and hence to the cuvette by means of the eccentric pin 17, which carries out a circular motion (see the arrow). This brings about the mixing of the cuvette contents by a rotational movement. The mobility of the cuvette holder 12 required for mixing is ensured by the flexible rubber disk 13, which is repeatedly pushed together by the motion of the cuvette holder. The coupling hole 15 has a chamfer arranged on its opening, which chamfer contributes to the coupling hole 15 always being able to be driven directly onto the eccentric pin 17, without the latter having to be driven into a certain position in advance.

Furthermore, the device has a Hall sensor 18, illustrated symbolically, arranged on the transfer arm, which Hall sensor registers the magnetic field emitted by a magnet 19 arranged on the cuvette holder 12, and more particularly is able to measure the movements of said magnet and transfer them to a monitoring apparatus (not illustrated).

Figure 2:
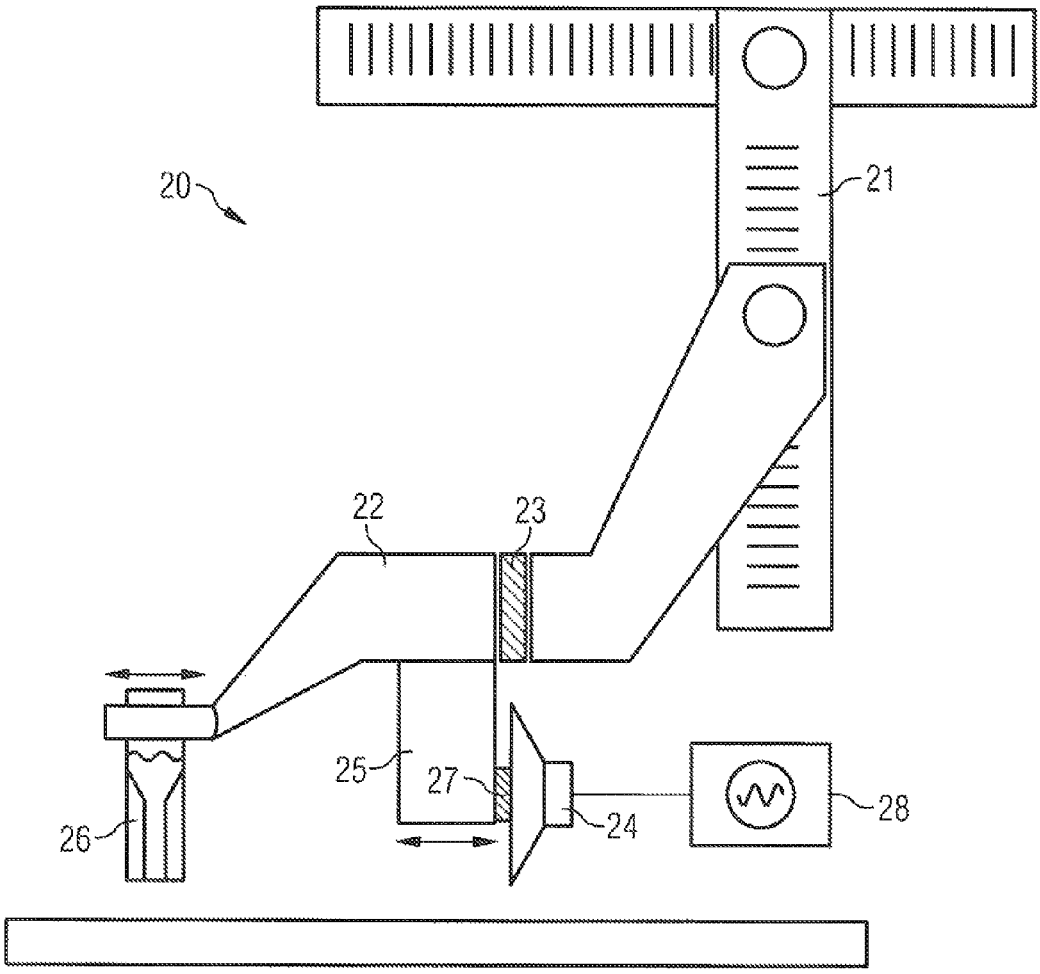
FIG. 2 likewise shows an embodiment of the device 20, in which the shaking apparatus 24 has a loudspeaker and the coupling apparatus 25 has a contact element 27.

FIG. 2 shows another embodiment of the device according to various embodiments. In this example, the device 20, which again is part of an analysis instrument, comprises a transfer arm 21, a holder 22 for a cuvette, a flexible intermediate element (in this case a rubber disk) 23 arranged between the transfer arm 21 and the cuvette holder 22, a shaking apparatus in the form of a loudspeaker 24, a coupling apparatus 25 with a contact element 27 arranged on the cuvette holder, and a cuvette 26.

As described in FIG. 1, the cuvette holder 22, and hence the cuvette 26 as well, can be displaced within the analysis instrument in the case of such a device by moving the transfer arm 21.

In order to mix the sample in the cuvette, the coupling apparatus 25 can be connected to the loudspeaker 24 via the contact element 27. For this purpose, the coupling apparatus 25 is driven against the loudspeaker 24 by moving the transfer arm 21. The loudspeaker itself is connected to a frequency generator 28, which causes the former to oscillate with the aid of an amplifier (not illustrated). The oscillations of the loudspeaker 24 can then be transmitted to the cuvette holder 22 and hence to the cuvette 26 via the contact element 27. This causes the contents of the cuvette to be mixed by a shaking movement depending on the amplitude and phase of the sound waves emitted by the loudspeaker. The mobility of the cuvette holder 22 required for mixing is ensured by the flexible rubber disk 23.

Deviating from the figures illustrated above, provision can moreover be made for the shaking apparatus to be moved for producing the detachable connection. Moreover, differently designed shaking apparatuses are also feasible and covered by the contents of the present patent application.

LIST OF REFERENCE SIGNS

10 Device for mixing a liquid sample
11 Transfer arm
12 Holder for a cuvette
13 Flexible intermediate element
14 Motor
15 Coupling hole
16 Cuvette
17 Eccentric pin
18 Hall sensor
19 Magnet
20 Device for mixing a liquid sample
21 Transfer arm
22 Holder for a cuvette
23 Flexible intermediate element
24 Loudspeaker
25 Coupling apparatus
26 Cuvette
27 Contact element
28 Frequency generator

What is claimed is:

1. A device for mixing a liquid sample, having a) a support arm, b) a holder for a liquid container configured to hold a liquid sample, c) at least one flexible intermediate element, arranged between the support arm and the holder for the liquid container, d) a shaking apparatus, and e) a coupling apparatus arranged on the holder for the liquid container and establishing a detachable connection between the shaking apparatus and the holder for the liquid container, wherein attachment and detachment of the detachable connection between the shaking apparatus and holder for the liquid sample is established by relative movement of the support arm and the shaking apparatus.

2. The device according to claim 1, wherein the flexible intermediate element consists of at least one of an elastic and damping material.

3. The device according to claim 2, wherein the flexible intermediate element consists of a rubber disk.

4. The device according to claim 1, wherein the support arm is a transfer arm, with the aid of which the holder for the liquid container can be moved.

5. The device according to claim 1, wherein the liquid container is at least one container selected from the group consisting of a microreaction vessel, a photometer cuvette, and a centrifuge vessel.

6. The device according to claim 1, wherein the device furthermore has a sensor that can be used to monitor the mixing procedure in the liquid container.

7. The device according to claim 1, wherein the shaking apparatus and the holder are only interconnected during the mixing procedure.

8. The device according to claim 1, wherein the holder for the liquid container has an integrally formed gripper for the liquid container.

9. The device according to claim 1, wherein the shaking apparatus is designed such that it can move.

10. The device according to claim 1, wherein the coupling apparatus has a coupling hole or a coupling pin, which is designed such that it can mesh with a complementary arrangement on the shaking apparatus.

11. The device according to claim 1, wherein the shaking apparatus has a motor-driven eccentric.

12. The device according to claim 1, wherein the shaking apparatus has a loudspeaker.

13. An automated sample analysis system comprising:

a mixing device comprising:

a) a support arm, b) a holder for a liquid container configured to hold a liquid sample, c) at least one flexible intermediate element, arranged between the support arm and the holder for the liquid container, d) a shaking apparatus configured to shake the holder to mix the liquid sample in the liquid container, and e) a coupling apparatus arranged on the holder for the liquid container and establishing a detachable connection between the shaking apparatus and the holder for the liquid container, wherein attachment and detachment of the detachable connection between the shaking apparatus and holder for the liquid sample is established by relative movement of the support arm and the shaking apparatus, and an analysis instrument configured to receive the liquid container from the mixing device and analyze the liquid sample mixed by the mixing device.

14. The automated sample analysis system according to claim 13, wherein the flexible intermediate element consists of at least one of an elastic and damping material.

15. The automated sample analysis system according to claim 14, wherein the flexible intermediate element consists of a rubber disk.

16. The automated sample analysis system according to claim 13, wherein the support arm is a transfer arm, with the aid of which the holder for the liquid container can be moved.

17. The automated sample analysis system according to claim 13, wherein the analysis instrument comprises one of a photometer and a polymerase chain reaction (PCR) cycler.

* * * * *